US008109021B2

(12) United States Patent
Jain et al.

(10) Patent No.: US 8,109,021 B2
(45) Date of Patent: Feb. 7, 2012

(54) WRAP AROUND SELF LAMINATING WRISTBAND

(75) Inventors: Sanjay K. Jain, St. Louis, MO (US); Mark Greer, O'Fallon, MO (US)

(73) Assignee: Laser Band, LLC, St. Louis, MO (US)

( * ) Notice: Subject to any disclaimer, the term of this patent is extended or adjusted under 35 U.S.C. 154(b) by 319 days.

(21) Appl. No.: 12/115,945

(22) Filed: May 6, 2008

(65) Prior Publication Data

US 2009/0277061 A1 Nov. 12, 2009

(51) Int. Cl.
*A44C 5/00* (2006.01)

(52) U.S. Cl. ..... 40/633; 283/75

(58) Field of Classification Search ..... 40/633, 40/665, 304, 316, 310; 428/42.1; 283/74
See application file for complete search history.

(56) References Cited

U.S. PATENT DOCUMENTS

| | | | | |
|---|---|---|---|---|
| 230,455 | A | 7/1880 | Wilcox | |
| 0,919,983 | A | 4/1909 | Walsh | |
| 922,948 | A | 5/1909 | Portmore | |
| 1,383,335 | A | 7/1921 | Penksa | |
| 1,517,456 | A | 12/1924 | Pulliam | |
| 2,054,227 | A | 9/1936 | Nichols | |
| 2,073,280 | A | 3/1937 | Lederer | |
| 2,553,676 | A | 5/1951 | Roos | |
| 2,641,074 | A | 6/1953 | Richmond | |
| 2,687,978 | A | 8/1954 | Vogt | |
| 2,914,166 | A * | 11/1959 | Bihler | 206/526 |
| 3,153,869 | A | 10/1964 | Twentier | |
| 3,197,899 | A | 8/1965 | Twentie | |
| 3,402,808 | A | 9/1968 | Yannuzzi | |
| 3,517,802 | A | 6/1970 | Petrie | |
| 3,585,743 | A | 6/1971 | Jeffers | |
| 3,660,916 | A | 5/1972 | McDermott et al. | |
| 3,854,229 | A | 12/1974 | Morgan | |
| 4,004,362 | A | 1/1977 | Barbieri | |
| 4,078,324 | A | 3/1978 | Wiebe | |
| 4,179,833 | A | 12/1979 | Knodel | |

(Continued)

FOREIGN PATENT DOCUMENTS

DE 202009015077 U1 1/2010

(Continued)

OTHER PUBLICATIONS

International Search Report for PCT/US2009/031979 dated Mar. 9, 2009.

(Continued)

*Primary Examiner* — Joanne Silbermann
(74) *Attorney, Agent, or Firm* — Thompson Coburn LLP

(57) ABSTRACT

A wrap around, self laminating wristband comprises a substantially transparent laminate strap with an imaging area for receiving printed information and one or more layers of adhesive adjacent the imaging area so that as the strap is wrapped around itself to overlie the imaging area it laminates it. Alternate embodiments provide for a snap closure to secure the wristband instead of adhesive, forming the imaging area with a coating of a thermally sensitive or active print material, adding one or more labels for common use with the wristband, forming the wristband in a page of multiple wristbands or with labels or separately, forming the wristband as part of a printer processable business form, and providing the wristband forms either with or without labels in a continuous fan fold or roll format.

34 Claims, 11 Drawing Sheets

U.S. PATENT DOCUMENTS 4,226,036 A 10/1980 Krug
4,233,715 A 11/1980 McDermott
4,370,370 A 1/1983 Iwata et al.
4,565,731 A 1/1986 Komatsu et al.
4,612,718 A 9/1986 Golub et al.
4,627,994 A 12/1986 Welsch
4,630,384 A 12/1986 Breen
4,682,431 A 7/1987 Kowalchuk et al.
4,696,843 A 9/1987 Schmidt
4,783,917 A 11/1988 Smith et al.
4,829,604 A 5/1989 Allen et al.
4,854,610 A 8/1989 Kwiatek
4,855,277 A 8/1989 Walter
4,914,843 A 4/1990 DeWoskin
4,941,210 A 7/1990 Konucik
4,950,638 A 8/1990 Yuyama et al.
4,956,931 A 9/1990 Selke
D312,654 S 12/1990 Giordano
4,978,144 A 12/1990 Schmidt et al.
4,991,337 A 2/1991 Solon
RE33,616 E 6/1991 Welsch
5,026,084 A 6/1991 Pasfield
5,045,426 A 9/1991 Maierson et al.
5,135,789 A 8/1992 Schmidt
5,222,823 A 6/1993 Conforti
5,227,004 A 7/1993 Belger
5,227,209 A 7/1993 Garland
5,283,969 A 2/1994 Weiss
5,311,689 A 5/1994 Lindsey
5,318,326 A 6/1994 Garrison
5,331,140 A 7/1994 Stephany
5,351,993 A 10/1994 Wright et al.
5,370,420 A 12/1994 Khatib et al.
5,381,617 A 1/1995 Schwartztol et al.
5,383,686 A 1/1995 Laurash
5,395,667 A 3/1995 Ohno et al.
5,401,110 A 3/1995 Neeley
5,418,026 A 5/1995 Dronzek, Jr. et al.
5,427,416 A 6/1995 Birch et al.
5,486,021 A 1/1996 Laurash
5,486,436 A 1/1996 Lakes
5,509,693 A 4/1996 Kohls
5,509,694 A 4/1996 Laurash et al.
5,518,787 A 5/1996 Konkol
5,524,934 A 6/1996 Schwan et al.
5,547,227 A 8/1996 Laurash et al.
5,560,657 A 10/1996 Morgan
5,581,924 A 12/1996 Peterson
5,586,788 A 12/1996 Laurash
5,595,404 A 1/1997 Skees
5,596,202 A 1/1997 Arakawa
5,598,970 A 2/1997 Mudry et al.
5,601,222 A 2/1997 Haddad
5,601,313 A 2/1997 Konkol et al.
5,630,627 A 5/1997 Stewart
5,637,369 A 6/1997 Stewart
5,648,143 A 7/1997 Mehta et al.
5,653,472 A 8/1997 Huddleston et al.
5,662,976 A 9/1997 Popat et al.
5,670,015 A 9/1997 Finestone et al.
5,687,903 A 11/1997 Akridge et al.
D391,991 S 3/1998 Conner
5,765,885 A 6/1998 Netto et al.
5,785,354 A * 7/1998 Haas ..... 283/74
5,842,722 A 12/1998 Carlson
5,877,742 A 3/1999 Klink
5,933,993 A 8/1999 Riley
5,984,363 A 11/1999 Dotson et al.
6,000,160 A 12/1999 Riley
6,006,460 A 12/1999 Blackmer
6,016,618 A 1/2000 Attia et al.
D423,044 S 4/2000 Burke et al.
6,053,535 A 4/2000 Washburn et al.
6,055,756 A 5/2000 Aoki
6,058,639 A 5/2000 Tinklenberg et al.
6,067,739 A 5/2000 Riley
6,071,585 A 6/2000 Roth
6,092,321 A 7/2000 Cheng et al.
6,108,876 A 8/2000 Hubbert
6,155,476 A 12/2000 Fabel
6,155,603 A 12/2000 Fox
6,159,570 A 12/2000 Ulrich et al.
6,199,730 B1 3/2001 Chisolm
D448,404 S 9/2001 Hamilton et al.
6,303,539 B1 10/2001 Kosarew
6,331,018 B1 12/2001 Roth et al.
6,343,819 B1 2/2002 Shiozaki
6,361,078 B1 3/2002 Chess
6,364,366 B1 4/2002 Schwartz
6,409,871 B1 6/2002 Washburn et al.
6,438,881 B1 8/2002 Riley
6,510,634 B1 1/2003 Riley
6,517,921 B2 2/2003 Ulrich et al.
D473,264 S 4/2003 Sanford et al.
6,611,962 B2 9/2003 Redwood et al.
6,641,048 B1 11/2003 Schintz et al.
6,685,228 B2 2/2004 Riley
6,748,687 B2 6/2004 Riley
6,782,648 B1 8/2004 Mosher, Jr.
6,807,680 B2 10/2004 Sloot
6,836,215 B1 12/2004 Laurash et al.
6,844,041 B2 * 1/2005 Squier et al. ..... 428/40.1
D503,197 S 3/2005 Stewart et al.
6,863,311 B2 3/2005 Riley
6,971,200 B2 12/2005 Valenti, Jr.
6,981,948 B2 1/2006 Pellegrino et al.
7,017,293 B2 3/2006 Riley
7,017,294 B2 3/2006 Riley
D521,565 S 5/2006 Stewart et al.
7,047,682 B2 5/2006 Riley
7,197,842 B2 4/2007 Ali
7,222,448 B2 5/2007 Riley
7,240,446 B2 7/2007 Bekker
7,286,055 B2 10/2007 Girvin et al.
7,523,576 B1 4/2009 Petty
D611,984 S 3/2010 Ali et al.
7,763,344 B2 7/2010 Riley et al.
7,779,569 B2 8/2010 Riley et al.
7,779,570 B2 8/2010 Riley
7,784,209 B2 8/2010 Greer
7,784,210 B2 8/2010 Riley et al.
7,818,908 B2 10/2010 Greer
7,823,310 B2 11/2010 Jain et al.
7,877,915 B2 2/2011 Jain et al.
7,883,018 B2 2/2011 Riley et al.
7,918,045 B2 4/2011 Riley
D640,738 S 6/2011 Jain et al.
2002/0152928 A1 10/2002 Lawandy et al.
2002/0176973 A1 11/2002 Keiser
2003/0001381 A1 1/2003 Riley
2003/0003249 A1 1/2003 Benim et al.
2003/0011190 A1 1/2003 Ryan
2004/0060216 A1 4/2004 Riley
2004/0068906 A1 4/2004 Riley
2004/0128892 A1 7/2004 Valenti
2004/0148836 A1 8/2004 Riley
2004/0244251 A1 12/2004 Riley
2005/0091896 A1 5/2005 Kotik et al.
2005/0108912 A1 5/2005 Bekker
2005/0279001 A1 12/2005 Riley
2005/0281989 A1 12/2005 Finger
2006/0230661 A1 10/2006 Bekker
2006/0236578 A1 10/2006 Saint et al.
2006/0242875 A1 11/2006 Wilson et al.
2006/0261958 A1 11/2006 Klein
2007/0089342 A1 4/2007 Jain et al.
2007/0120358 A1 5/2007 Waggoner et al.
2007/0243361 A1 10/2007 Riley et al.
2007/0257113 A1 11/2007 Davis et al.
2008/0098636 A1 5/2008 Greer
2009/0094872 A1 4/2009 Ali et al.
2009/0193701 A1 8/2009 Greer
2009/0282717 A1 11/2009 Jain et al.
2010/0071241 A1 3/2010 Jain et al.
2010/0253060 A1 10/2010 Riley et al.
2010/0281724 A1 11/2010 Greer et al.
2011/0000114 A1 1/2011 Riley et al.

FOREIGN PATENT DOCUMENTS

| | | | |
|---|---|---|---|
| EP | 1039431 | | 9/2000 |
| EP | 1974603 | A2 | 10/2008 |
| FR | 2806594 | A | 9/2001 |
| GB | 960859 | | 6/1964 |
| GB | 2045718 | | 11/1980 |
| GB | 2160492 | | 12/1985 |
| GB | 2228915 | A | 9/1990 |
| JP | 63175913 | A | 11/1988 |
| JP | 5-61777 | | 8/1993 |
| JP | 08-190350 | | 7/1996 |
| JP | 08299035 | A | 11/1996 |
| JP | 3032299 | | 12/1996 |
| JP | 10-207374 | | 8/1998 |
| JP | 11015383 | A | 1/1999 |
| JP | 2001316921 | A | 11/2001 |
| JP | 2002117190 | A | 4/2002 |
| JP | 2002351321 | A | 12/2002 |
| JP | 2003066849 | | 3/2003 |
| JP | 2003157010 | | 5/2003 |
| JP | 2003164307 | | 6/2003 |
| JP | 2006039209 | | 2/2006 |
| WO | 9502877 | | 1/1995 |
| WO | 96/12618 | | 5/1996 |
| WO | 98/23081 | | 5/1998 |
| WO | 99/18817 | | 4/1999 |
| WO | 02/39412 | | 5/2002 |
| WO | 03/003331 | | 1/2003 |
| WO | 2004/028826 | | 4/2004 |
| WO | 2005/064574 | | 7/2005 |
| WO | 2006/007356 | | 1/2006 |
| WO | 2007/021375 | | 2/2007 |
| WO | 2007/133906 | | 11/2007 |
| WO | 2008/079952 | A2 | 7/2008 |
| WO | 2009099787 | A1 | 8/2009 |
| WO | 2009/137195 | | 11/2009 |
| WO | 2010129131 | | 11/2010 |

OTHER PUBLICATIONS

International Preliminary Report on Patenability (Chapter II) for PCT/US2009/031979 issued May 21, 2010.
International Preliminary Report on Patentability (Chapter II) for PCT/US2009/039183 issued Apr. 20, 2010.
International Preliminary Report on Patentability (Chapter II) for PCT/US2008/059616 dated Jul. 14, 2009.
International Search Report for PCT/US2009/039183 dated Jun. 25, 2009.
International Search Report and Written Opinion for PCT/US2010/030361 dated Jul. 16, 2010.
International Preliminary Report on Patentability (Chapter I) for PCT/US2008/064972 dated Dec. 1, 2009.
Office Action for CA Application 2667271 dated Dec. 30, 2010.
Office Action for EP Application 01993920.6 dated Dec. 29, 2010.
Office Action for EP Application 05757812.2 dated Dec. 28, 2010.
Office Action for CA Application 2567762 dated Apr. 11, 2011.
Office Action for CN Application 200680035179.8 dated Apr. 1, 2011.
Office Action for EP Application 03773060.3 dated Apr. 6, 2011.
Office Action for U.S. Appl. No. 12/847,271 dated Mar. 31, 2011.
Office Action for U.S. Appl. No. 12/252,654 dated Aug. 12, 2010.
Office Action for U.S. Appl. No. 12/819,709 dated Aug. 19, 2010.
Office Action for U.S. Appl. No. 11/455,131 dated Aug. 31, 2010.
Office Action for U.S. Appl. No. 12/627,227 dated Aug. 31, 2010.
Office Action for AU Application 2007317692 dated Aug. 12, 2010.
Office Action for AU Application 2006280450 dated Aug. 31, 2010.
Office Action for CN Application 03825215.5 dated Aug. 30, 2010.
Office Action for JP Application 2007-516565 dated Jul. 13, 2010.
Office Action for U.S. Appl. No. 12/435,541 dated Oct. 29, 2010.
Office Action for U.S. Appl. No. 12/819,709 dated Nov. 8, 2010.
Office Action for EP Application 07842781.2 dated Oct. 25, 2010.
Office Action for U.S. Appl. No. 12/026,030 dated Dec. 9, 2010.
Office Action for CA Application 2549631 dated Nov. 25, 2010.
Office Action for CA Application 2679181 dated Nov. 19, 2010.
Office Action for U.S. Appl. No. 11/373,923 dated May 17, 2011.
International Preliminary Report on Patentability (Chapter II) for PCT/US2010/030361 issued May 13, 2011.
Office Action for U.S. Appl. No. 12/847,271 dated Jun. 28, 2011.
Office Action for EP Application 06785676.5 dated Jul. 22, 2011.
Office Action for JP Application 2006-547497 dated May 17, 2011.
Office Action for JP Application 2007-516565 dated May 17, 2011.
Brochure entitled: "Integrated Document Management Software"; Smead Manufacturing Company; Date Unknown; Form No. SLI-95.
Catalog entitled: "Reseller Catalog Number One"; Smead Software Solutions ; Date Unknown; Form No. SSS-RC1-00.
Sample of Standard Register Labels.
Standard Register, P.S. Magazine, Fall 1998, Dayton, Ohio.
Gretchen Berry, "Wrist Watch," Advance for Healthcare Information Professionals, Feb. 15, 1999.
Sample of Standard Register Label.
"Yes, Sir, That's My Baby!," Material Management in Health Care, Feb. 1999, vol. 8, No. 2, Health Forum, Inc.
Disaster Management Systems, Inc., Triage Tag, Copyright 1996, Pomona, California.
Maryland Department of Transportation, Maryland Emergency Medical Services, Triage Tag, Copyright MIEMMS 1999, Maryland.
Posey Movable I.D. Bracelet; downloaded from http:/www.posey.com/products/4648.html on Aug. 18, 2004.
Avery Dennison DuraCard.
Avery Laminated Identification Cards #5361.
Brochure entitled: "Color-Bara—Click Stripa Labeling System"; Smead Manufacturing Company; Date Unknown; Form No. SSS-CS-00.
Brochure entitled: "Color-Bar a Folders"; Smead Manufacturing Company; Date Unknown.
ID Warehouse (http://web.archive.org/web/20050131235601/http://idwarehouse.com/) Jan. 31, 2005. p. 1: WB1908, Stock Vinyl Wristband.

* cited by examiner

WRAP AROUND SELF LAMINATING WRISTBAND

BACKGROUND AND SUMMARY OF THE INVENTION

Self laminating wristbands have become widely available for medical applications and have achieved great commercial success principally through the inventive efforts of the assignee of the present invention. Examples of the several different embodiments of the self laminating wristbands that have received patents and which are experiencing great commercial success may be found in one or more of the following US patents, the disclosures of which are incorporated herein by reference: U.S. Pat. Nos. 5,933,993; 6,438,881; 7,017,293; and 7,222,448.

These self laminating wristbands are formed in part with a clamshell of laminating layers which are hinged together so that after separation of the wristband from the carrier the two clamshell halves are folded over to laminate an imaging portion. In almost all of these embodiments, the clamshells are hinged along their long dimension although at least one embodiment depicts the clamshell hinged at their ends. With this arrangement, the imaging area which is adhered to one of the clamshell halves is positioned to be readily laminated by merely folding over the two halves along the hinge joining them. This provides a quick and easy method for "assembling" or laminating the wristband after its separation from the carrier, and then applying it to the patient's wrist. Many millions of these design wristbands, in a number of different formats and arrangements, have been sold by the assignee, and customers/users have used them as they have found them to be ideally suited to their many applications.

In its continuing efforts to improve and develop alternate design wristbands, the inventor herein has developed for the assignee a new inventive design wrap around self laminating wristband which is elegantly simple, perhaps even simpler than the previous clamshell design, and which is arguably also faster to separate from the carrier and apply to the patient's wrist. In essence, this new invention comprises a slightly longer single width, substantially transparent strap having an imaging end for carrying the printed image and an opposite or "window" end for overlying the imaging end to laminate it. In other words, this design departs from the clamshell arrangement the assignee has commercialized to great success and instead provides a single strap which wraps around the patient's wrist with the opposite end providing a lay over see-through laminate or window area which is affixed in one of several alternative manners to attach the wristband to the wearer's wrist. While the entire strap may be provided as substantially transparent, as an alternative a decorative design may obscure a portion of the strap length to actually form a window through which the printed image may be viewed. In that embodiment, the window is preferably provided in a length appreciably longer than the imaging area to allow for adjustability in the amount of overlap, and thus wristband length, while ensuring that the imaging area is visible therethrough. While a "see-through" laminate is preferred, it is also possible that one or more cutouts could be provided to enhance the readability of a bar code, for example, or for any other purpose. Also, in some embodiments, the imaging area end may preferably be slightly smaller in width so that the strap can be wrapped around the wrist and the window end may be slightly misaligned or even be "loose" but yet completely cover and laminate the imaging area with its surface being entirely visible through the window. Yet another alternative is for the wristband to have a curved, contoured or curvilinear edge along at least a portion of at least one of its sides, maybe even to the extreme of an hourglass or "wasp-waisted" band formed along both edges of both sides, or to have contoured sides as exemplified by the disclosure found in co-pending application Ser. No. 11/553,873 filed Oct. 27, 2006, the disclosure of which is incorporated herein by reference A number of alternate arrangements for the "wraparound" wristband of the present invention have been conceived of. For example, instead of providing a two ply form, a single ply laminate strap can be provided separately from a printed face stock label and the two assembled by adhering the label to the laminate strap before wrapping the strap around the patient's wrist. The label can be provided as self adhering and separate patches or stripes of adhesive be provided on the laminate strap, either to completely enclose the label as the wristband is secured or merely to attach the "wrapped" end to the opposite end so that while the label is captured between two outer layers of laminate it is not totally encapsulated by the overlying laminate strap. And, the adhesive may be applied on either side of the label so that the laminate strap may have its end either fixed or loose. For convenience, the word "laminate" or "laminating" is used herein to refer to an arrangement where two layers of laminate capture an imaging area therebetween, but not necessarily encapsulate it. In some instances the laminate layers may be adhered together to completely encapsulate the imaging area, as in most of the other self laminating wristband designs disclosed in the assignee's other patents. In other instances, however, the sides or the ends or even the sides and ends of the laminate overlay may not be affixed in place. For purposes of this disclosure, these arrangements shall also be considered as satisfying the "laminate" or "laminating" definition.

As this design wristband requires a "wrapping around" or overlap of one end over the other, the length of the wristband is preferably slightly longer than a corresponding "finished length" self laminating wristband of the clamshell design. This is not an issue should the wristband be intended for smaller wrists, such as for pediatric applications, and this design may be conveniently die cut into a standard 8½×11 inch sheet for laser printer processing. This design is also adaptable for adult sized wristbands for laser printing in a slightly longer sheet, such as legal size or 8½×14 inches. Nor is this an issue when the wristband business forms are provided in a continuous strip, either fan fold or roll, such as would be intended for thermal printing applications. As the most common format for wristbands is in combination with a plurality of labels, this design wristband is uniquely suited for thermal printers where the overall width of the form is limited by the throat size of the printer. Due to it being a single width, a wristband of the present invention would occupy the top half of a nominal two inch (2") wide form and the bottom half would be occupied by a series of labels. Thus, a self laminating, adult sized, self laminating wristband along with a plurality of labels are conveniently provided in a continuous strip or roll format in two inch width suitable for processing by most thermal printers. As explained above, this design is versatile and suited to many formats.

The "stock" from which this design wristband would preferably be provided in would be the common two ply stock comprised of a face or imaging ply adhered with a pattern adhesive to a backing or laminate ply. The wristband would then be die cut into both of the face ply and the laminate ply: the imaging area die cut into the face ply and the strap die cut into the laminate ply. Depending on the pattern of the adhesive, for example should there be no adhesive joining the length of the strap and window to the face ply, the die cut could be an "interrupted" die cut with for example nicks in the die which would leave behind "ties" of both or at least one ply to hold at least the laminate strap in place before desired removal and use of the wristband. Then, the user would tear the strap loose along the interrupted die cut after printing. A "surround" of adhesive would preferably be applied around the image area, and would be exposed after separation of the wristband from the carrier so that it would adhere to the portion of the window end overlying the imaging area to "laminate" it by substantially encapsulating it in this embodiment.

As an alternate in the embodiments disclosed herein, instead of providing a label or face stock ply, the imaging area may be formed for a thermal printer version by applying an opaque white base coat followed by a thermal active coating and for increased durability a protective top coating if desired to a single laminate ply, either in the desired area or across the entire ply as determined by cost, raw stock, forming machine capabilities, etc. The coating material provided may be any chosen from a group of suitable materials chosen as would be known by those of ordinary skill in the art. Examples are Environmental Inks & Coatings EH012552 Direct Thermal coating, EC007094 Opaque white base coat and Organic Dyestuffs Corporation ORCO Black ODB-2 Leuco-dye thermal coat. This "stock" material could be used to form single wristband sheetlets, multiple wristband sheets, "combo" forms with labels in sheet format, and thermal printer formats comprising continuous strips in fan fold or roll format as well as any other format as exemplified in the various other patent filings owned by the assignee.

Yet another alternate embodiment incorporates mechanical fasteners to close the wristband about the wearer's wrist. One such example is a snap closure which would be located at each side of the "wrapped end" and two series of holes located along the strap edges inboard of the imaging area, one of which each snap closure would fasten to and join the strap ends. The length of the finished wristband would thus be variable depending on which pair of holes the snap closures were fastened to. In this embodiment, the laminate would overlie the imaging area but need not be sealed on any edge. As an alternative to including the mechanical fastener in the wristband, they may also be provided separately with the wristband having pre-punched holes or other areas of weakness to accommodate the assembly of the mechanical fastener after the wristband may be processed and printed.

While the principal advantages and features of the present invention have been briefly explained above, a fuller understanding may be gained by referring to the drawings and description of the preferred embodiments which follow.

DETAILED DESCRIPTION OF THE PREFERRED EMBODIMENTS

Figure 1:
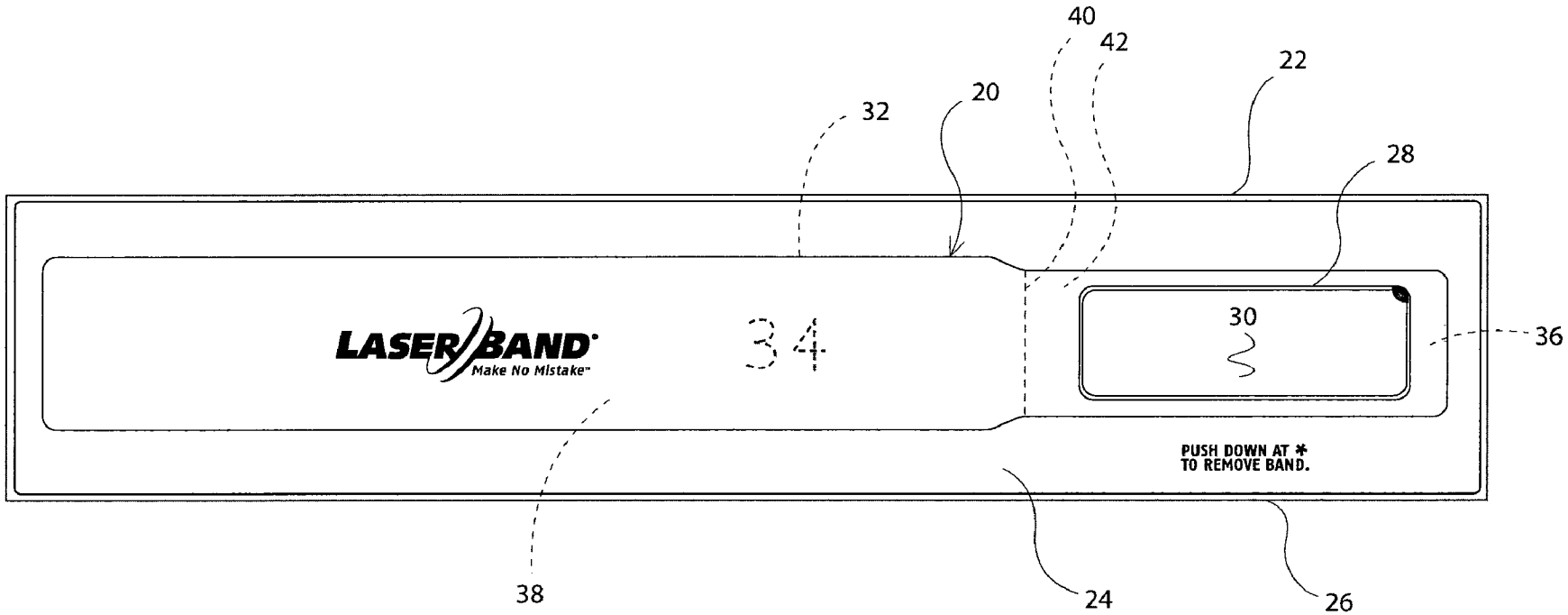
FIG. 1 is a plan view of the wraparound wristband formed in a two ply carrier.

A first embodiment of the wraparound self laminating wristband 20 of the present invention is depicted in FIG. 1 and includes a two ply carrier 22 comprised of a top face ply 24 and a bottom laminate ply 26. A first die cut 28 in the face ply 24 forms an imaging area 30 and a second die cut 32 in the bottom laminate ply 26 forms a wristband strap 34. Die cut 32 may be an interrupted die cut, as depicted in other figures. The laminate wristband strap 34 is shown to preferably have a narrower end 36 whereat the imaging area 30 is adhered and a wider end 38. A dotted line 40 near the neck joining the narrower end 36 with the wider end 38 indicates the end of where a layer of adhesive 42 is applied to the narrower end 36 of wristband strap 34. A layer of release (not shown) surrounds the imaging area so that when the wristband 20 is separated from the carrier 22 it exposes the adhesive surrounding the imaging area 30. As there is preferably no release layer separating the laminate strap 32 from the imaging area 30, it remains adhered and separates with the laminate strap upon separation from the carrier 22 although it will separate with the laminate strap even if a release layer is applied if the directions for separating the wristband are followed. After separation by pushing down at the corner of the imaging area 30, the wristband 20 is applied to a wearer's wrist by wrapping the wider end 38 of laminate ply 34 about the wrist and pressing it over the top of the imaging area 30 to completely cover it and the surrounding layer of adhesive 42 adheres the two laminate layers together to laminate the imaging area 30. In this embodiment the wider end 36 helps allow for its inexact alignment over the imaging area 30 but which will still completely seal and encapsulate it. Any excess length may be trimmed off for comfort and to help guard against any patient discomfort from a floppy loose end.

Figure 2:
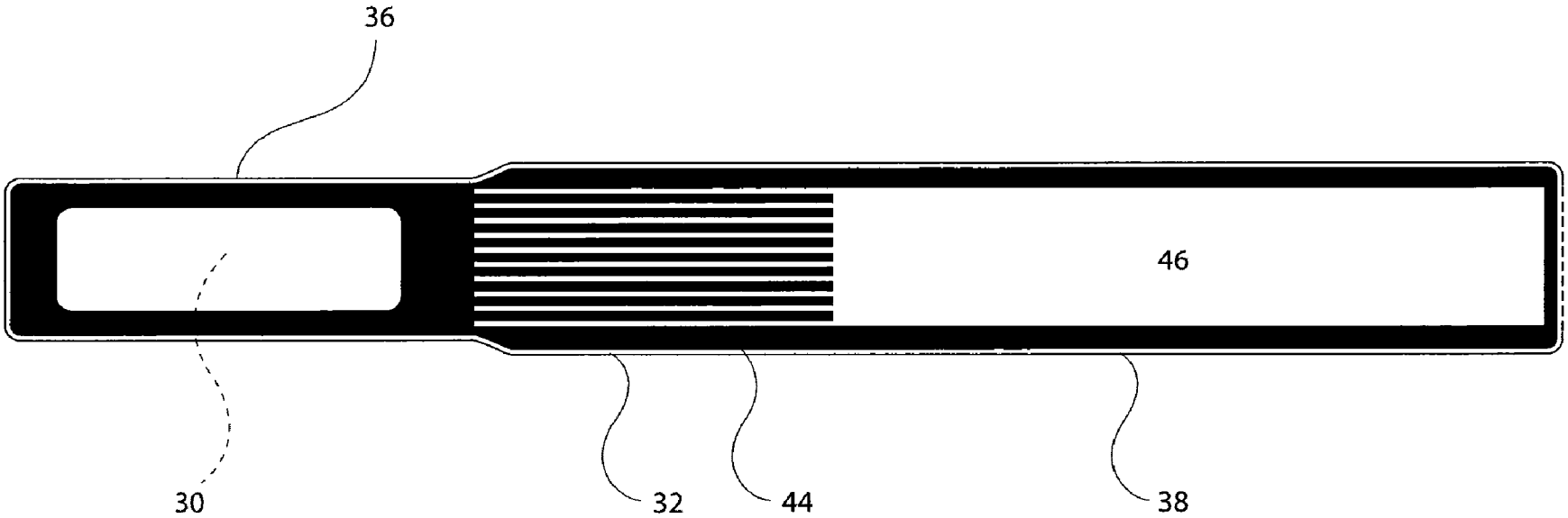
FIG. 2 is a bottom view of the wraparound wristband separated from the carrier and having a decorative imprint defining a window at the opposite end.

As shown in FIG. 2, the laminate strap 32 may be imprinted with a decorative pattern 44 to define a window 46 through which the imaging area 30 may be viewed. By making the window 46 substantially longer than the imaging area 30, the wristband may be sized to fit different wrists and yet ensure that a portion of the window 46 overlies the imaging area 30 to allow for its viewing. This is an alternative to providing the strap 32 as completely transparent.

Figure 3:
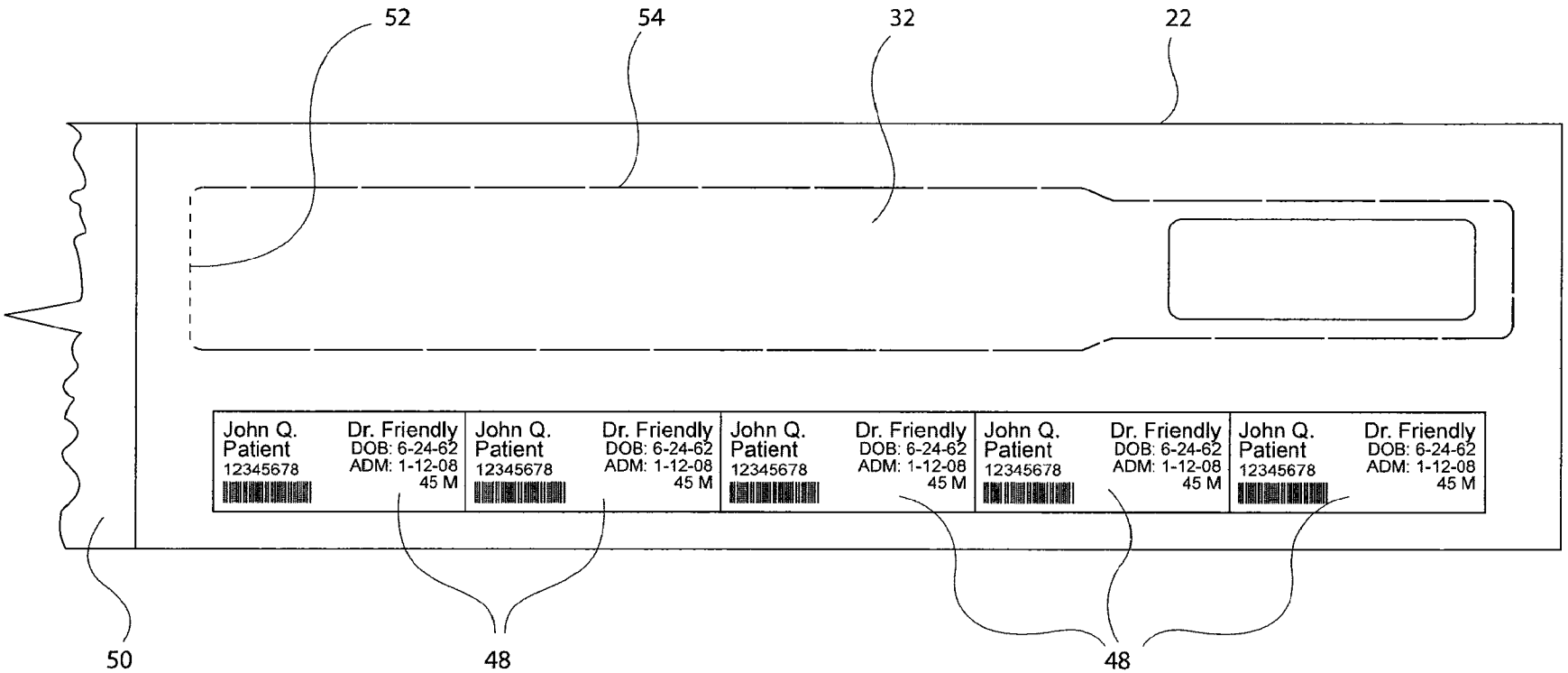
FIG. 3 is a plan view of a wraparound wristband with labels arranged in a strip orientation.

The wristband 20 may be provided in a continuous construction, with a series of labels 48 in a continuous strip 50 as depicted in FIG. 3. Also as shown in FIG. 3 is a line of perforation 52 at an end of the wristband laminate strap 32 which is of slightly different construction than the interrupted die cut line 54 also shown therein. The perforation line 52 provides slightly greater resistance to separation of the strap 32 from the carrier 22 than the interrupted die cut 54 and thus provides greater assurance that the strap 32 will not unintentionally separate during processing through a printer and other handling prior to use. With this increased strength, the perforation essentially forms a hinge. All of these variations are considered to be lines of weakness or die cuts, as those terms are used herein. Furthermore, the die cut to be used is to some extent a matter of design choice and depends on field testing in various applications with various materials, and the invention is not intended to be limited to the choice of die cut, etc. unless expressly so stated.

Figure 4:
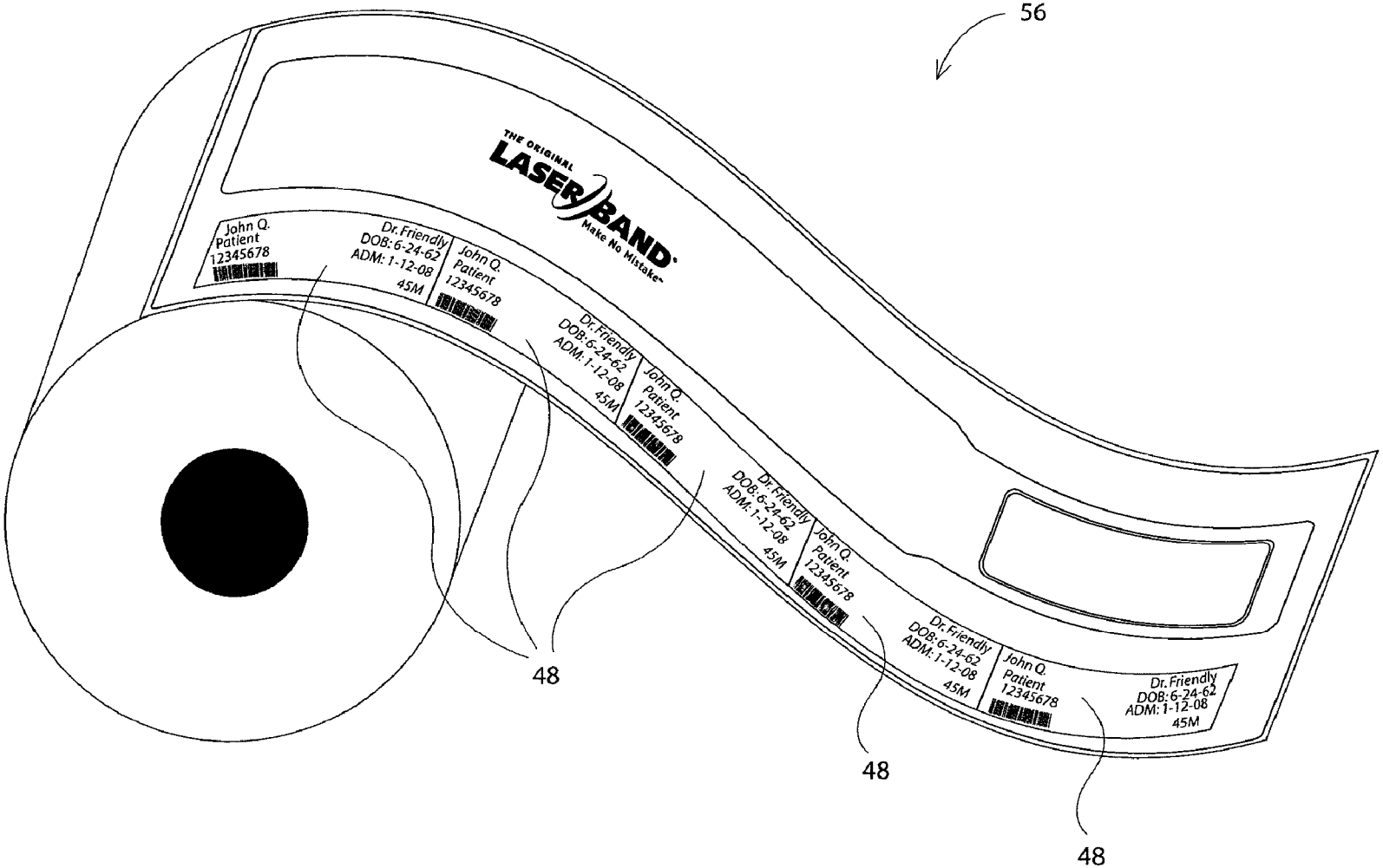
FIG. 4 is a perspective view of a roll of the wraparound wristband and label combo form depicted in FIG. 3.
Figure 5:
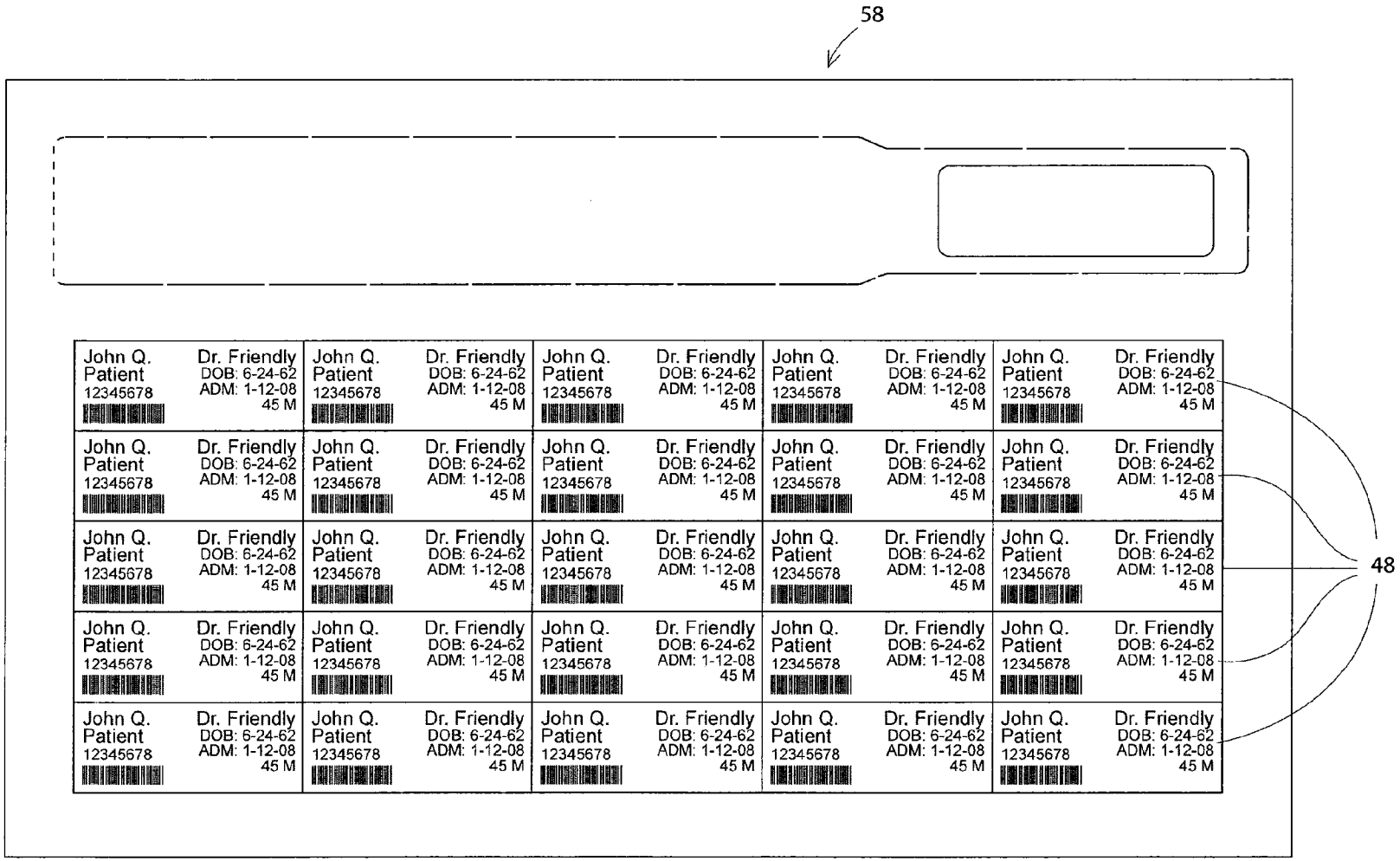
FIG. 5 is a plan view of a wraparound wristband with labels arranged in a page format.

The continuous construction depicted in FIG. 3 may be provided in a fan fold configuration or in a roll format 56 as depicted in FIG. 4. Yet another format for use is as a page 58 as depicted in FIG. 5. In the formats depicted in FIG. 3-5, the web construction underlying the self adhering labels 48 may preferably be different, with a different backing sheet or web (not shown) having a release layer applied to it to expose the layer of adhesive applied to the labels 48 as they are removed from the carrier 22, as known in the art and as shown in various other patents owned by the assignee including those noted above.

Instead of a layer of adhesive, one or more mechanical fasteners such as snap closures 60 each having an associated series of holes 62 may be used to attach the wristband about a wearer's wrist. Each snap closure may preferably include a male member 64 which inserts first through one of its associated holes 62 and then into a female member 66 to secure the wristband strap. When so fastened, one end of the laminate strap 32 overlies the imaging area 30 which may be a label separately supplied or provided as part of the wristband 20 formed as part of or on a carrier 22. In this embodiment the laminate strap 32 overlies the imaging area but preferably no adhesive is used so that the edges are not sealed, but nevertheless are laminated as that term is used herein. Should the wristband 20 shown in FIG. 6 be provided without a carrier 22, the strap 32 is preferably constructed of a somewhat heavier or thicker laminate and the imaging area 30 may preferably be a self adhering label.

Figure 6:
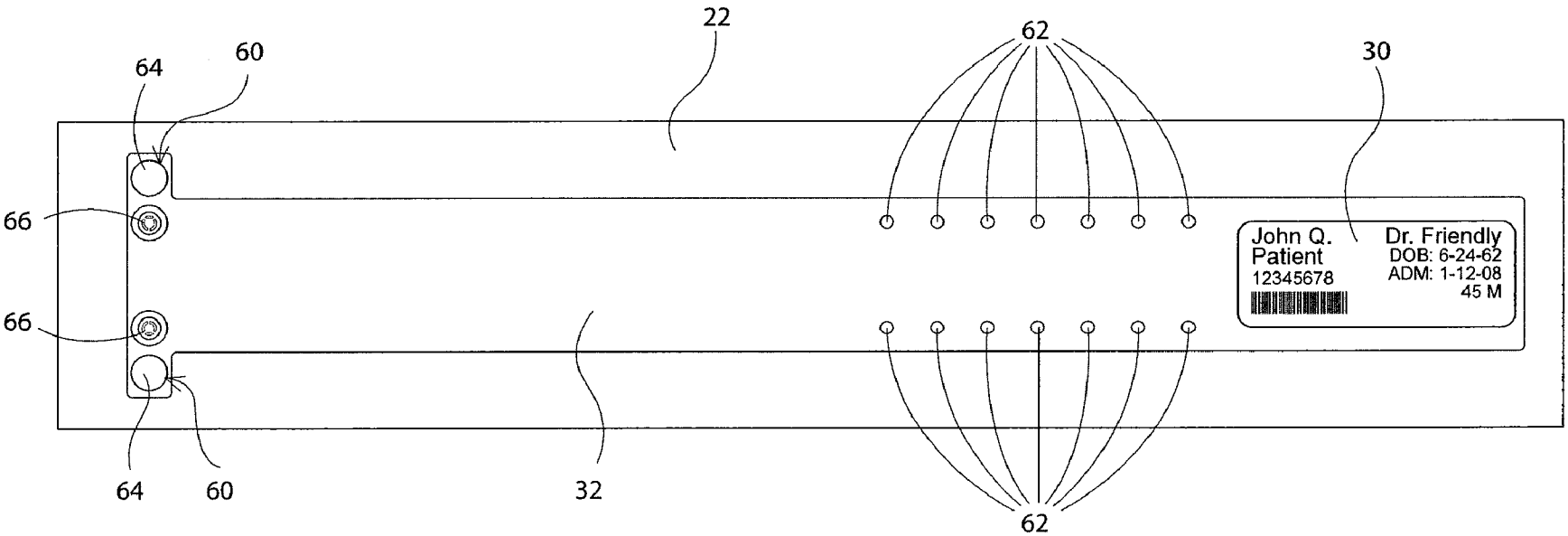
FIG. 6 is a plan view of a wraparound wristband in a carrier with a pair of snap closures and associated series of holes for attaching the wristband.
Figure 7:
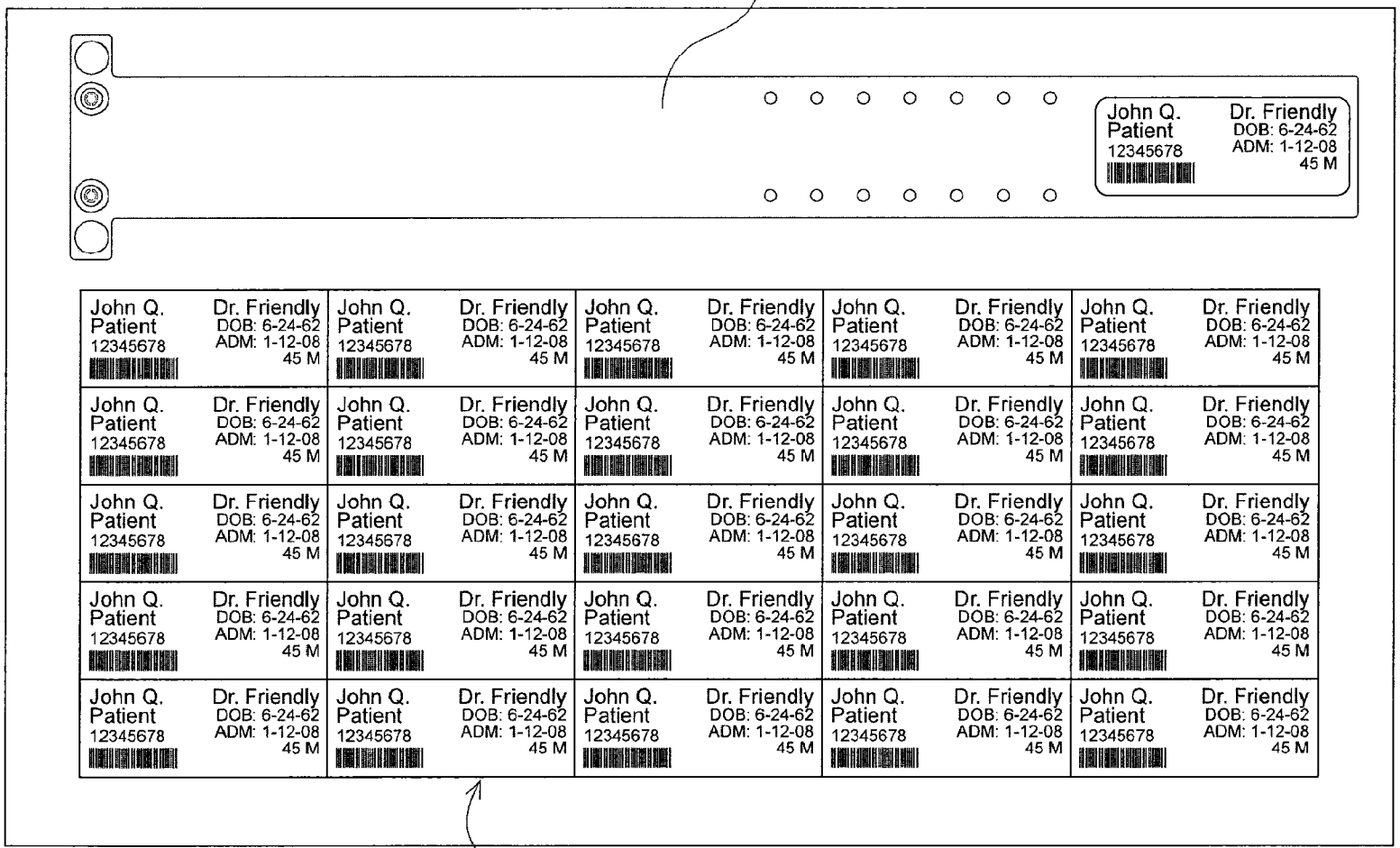
FIG. 7 is a plan view of the wraparound wristband with snap closures and a matrix of labels arranged in a page format.
Figure 8:
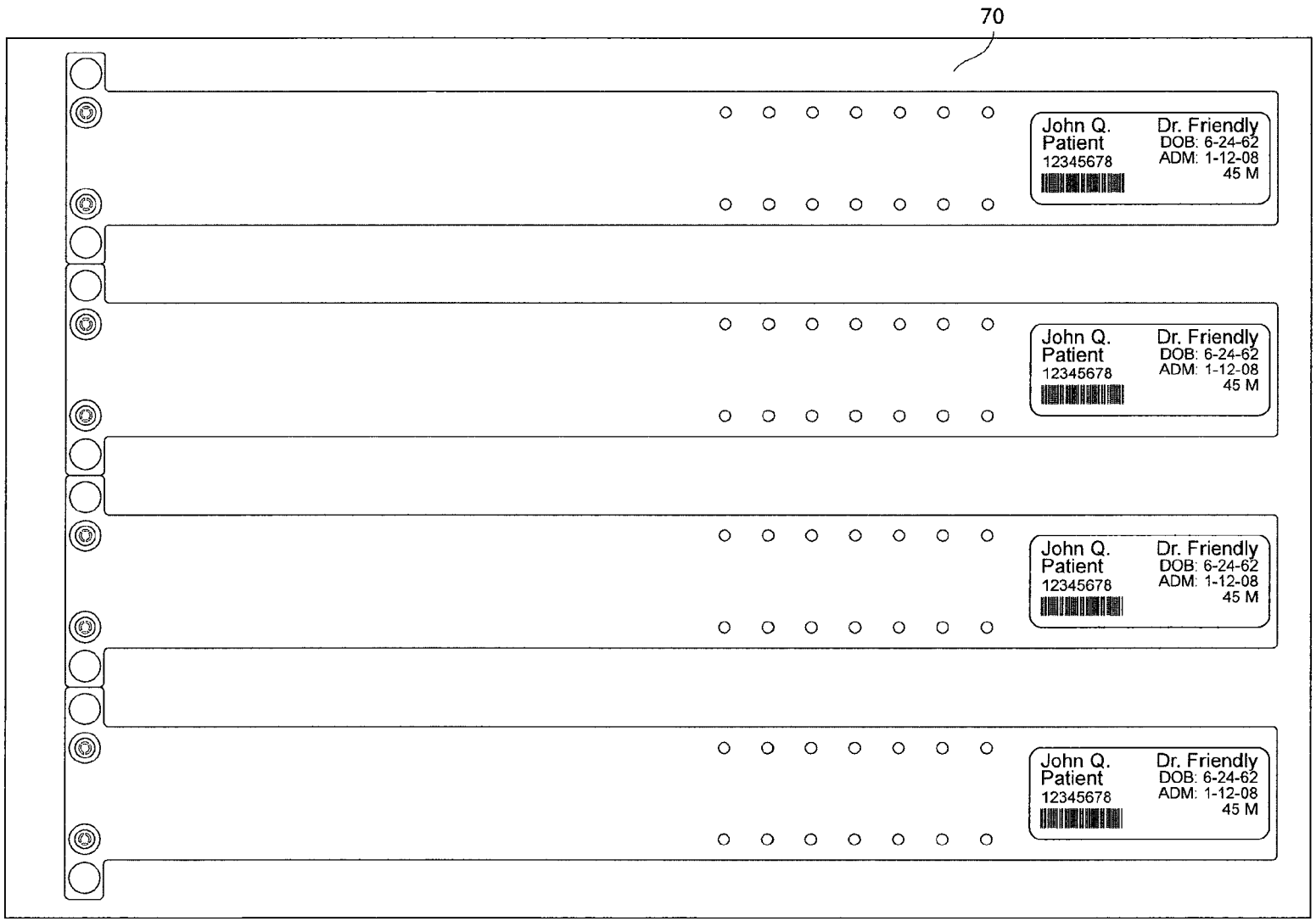
FIG. 8 is a plan view of a plurality of wraparound wristbands with snap closures formed in a page format.

The wristband 20 as depicted in FIG. 6 may be combined and provided with a matrix of labels 68 in a page format as shown in FIG. 7, or provided as a group of wristbands only in a page 70 as shown in FIG. 8.

Figure 9:
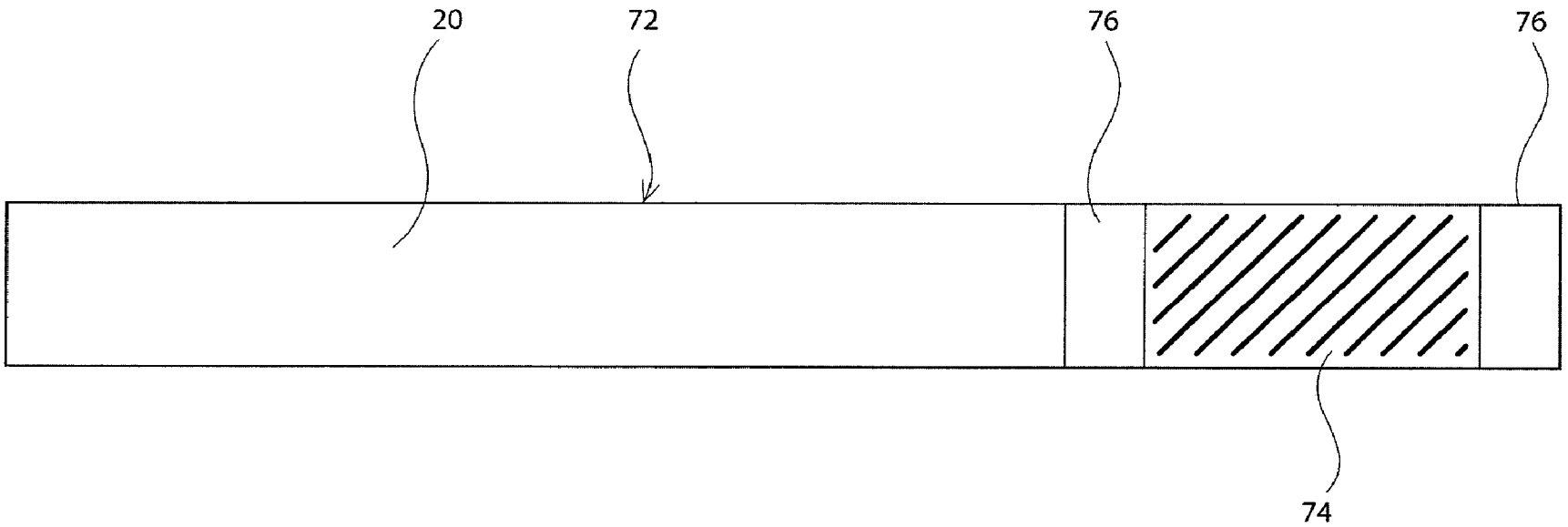
FIG. 9 is a plan view of a separated wraparound wristband having a pair of adhesive strips straddling an imaging area formed by a coating process.

Yet another embodiment is depicted in FIG. 9 and includes a single laminate strap 72 with an imaging area 74 surrounded by a pair of adhesive patches or stripes 76. As depicted in FIG. 9, the wristband is essentially a strap and is formed by being die cut into a carrier, similar to that shown in FIG. 8 and described below. The strap may be thinner or thicker, as desired to suit the particular parameters of its intended use. Imaging area 74 may be a separately supplied and printed label, or may be a coating of a thermally receptive print material as described in greater detail above. To secure the wristband 20 of FIG. 9, the opposite end is wrapped around to overlie the two stripes of adhesive 76 and included imaging area 74 and pressed together. When properly adhered, the two ends of the imaging area 74 are sealed but not the sides, but nevertheless are laminated as that term is used herein.

Figure 10:
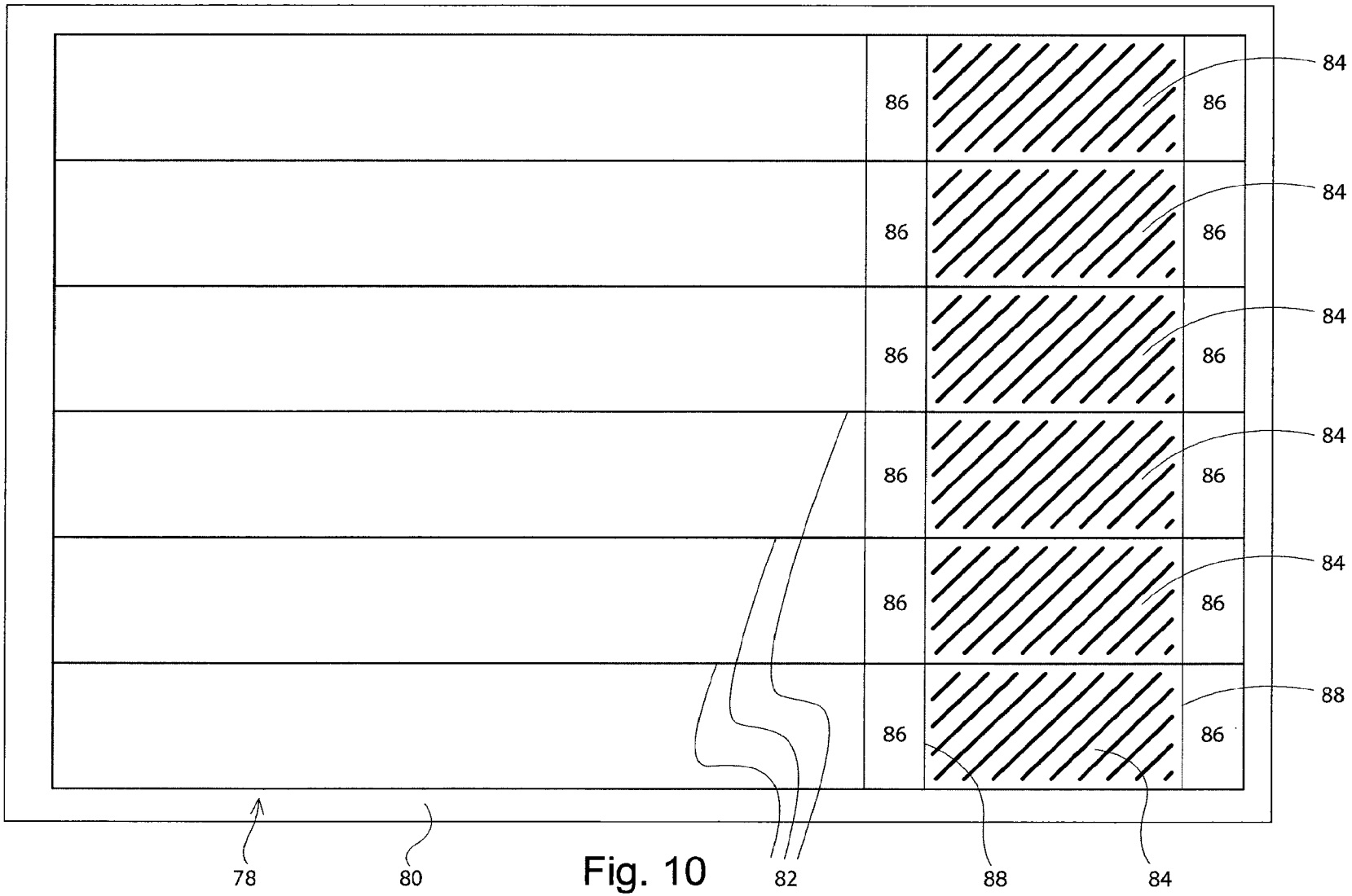
FIG. 10 is a plan view of a plurality of wraparound wristbands as shown in FIG. 9 arranged in a page format.
Figure 11:
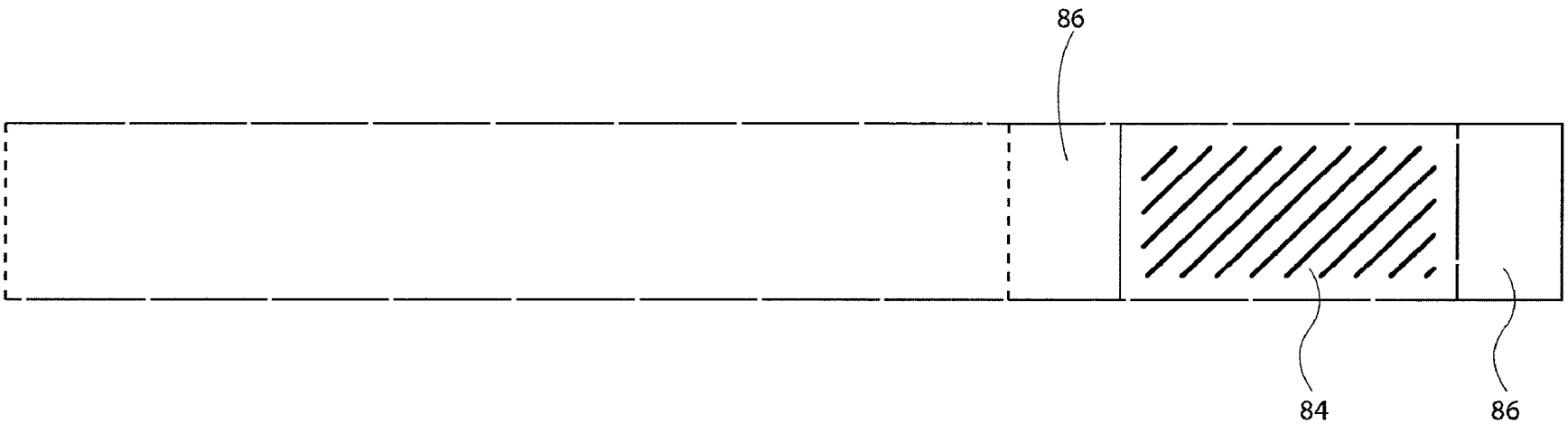
FIG. 11 is a plan view of a separated wraparound wristband having a single adhesive stripe at its end.

FIG. 10 depicts several variations for the wristband shown and described for FIG. 9. A plurality of wristbands 20 may comprise a page 78, either with or without a carrier 80. Adjacent wristbands 20 may be preferably separated by a line of weakness 82 so that they may be readily separated and individually used. An imaging area 84 is separately formed on each wristband 20 and is depicted as having a stripe of adhesive 86 on either side thereof, although alternatively a single stripe of adhesive may be provided on either side of the imaging area for each wristband as depicted in FIG. 11. The imaging area 84 may be formed from a coating of thermally receptive material and applied in a continuous fashion to the page of laminate prior to the die cuts 82 being made. Also, imaging areas 84 may be formed from a face stock ply adhered to the laminate ply comprising page ply 78. Further, the face stock ply used to form the imaging areas 84 may be readily extended to cover the adhesive stripes and die cuts 88 made to form removable tabs for exposing the adhesive stripes upon application to a wearer's wrist.

Various materials may be used as envisioned by the inventor. For example, polyethylene or Polyester or polypropylene may preferably be used for lighter and thinner laminate straps preferably having a thickness of about 1.5 to about 4 mil. For heavier and thicker laminates straps, Vinyl, polyethylene or polyurethane may preferably be used and preferably have a thickness of from about 4 to 12 mil. The face stock may preferably be standard #20 bond, or any other suitable paper stock as known in the art. Adhesives are also well known and their selection would be a matter of design choice depending on whether the wristband is intended to be processed through a laser or thermal printer. The imaging area may be formed by preferably applying a coating of EIC EH012552 or ORCO Black ODB-2 as a thermally receptive print material, preferably to a thickness of between about 0.1 to about 0.5 mil. These materials are all well known to those in the art and other suitable materials may be substituted therefor depending on the cost, availability, application and other design parameters.

While the invention has been disclosed in an illustrative manner through the drawing figures and description of the preferred embodiments, it would be apparent that other alternatives are included within the scope of the invention which should be limited solely by the scope of the appended claims and their equivalents. For example, other mechanical fasteners than snap closures may be used to fasten the wristband about the wearer's wrist. The imaging area may be formed as part of an overlying face stock ply or web, applied as a self adhering label after being printed with the desired information, applied as a thermally receptive print coating and then processed through a thermal printer, or otherwise. The laminate strap may have a substantially constant width along substantially the entirety of its length, have a narrower end at the imaging area, or have other shapes depending on the particular application. The laminate strap may be sized to overlap and be secured at intermediate locations allowing for it to be used on people having differently sized wrists. Thus, the laminate strap may have a variable length to suit the particular application. Adhesive stripes or patches may be applied in different locations, so long as they may be used to secure the wristband about the wearer's wrist. Although mention is made throughout this disclosure about a wearer's wrist, it should be understood that any wearer's appendage would be amenable for application of the present invention, and the term "wristband" has been used merely for convenience. Wristbands may be formed individually, in multiple numbers as part of a page of wristbands, combined with labels into "combo" forms, be formed in a reduced page size commonly referred to as a Sheetlet, or otherwise. Still other variations may be readily arrived at by those of skill in the art given the present teaching and these variations are intended to be included within the scope of this invention.

What is claimed is:

1. A printer processable business form comprising a wrap around, sell laminating wristband, said wristband comprising a wristband width laminate strap having an integrally formed window at one end, an imaging portion at the opposite end, and an adhesive applied to only that portion of said strap proximate the imaging portion when laminated so that wrapping said window end around a wearer's wrist to overlie the imaging portion and adhere it thereto thereby solely laminates the imaging portion and leaves the rest of the strap with substantially no exposed adhesive to contact the wearer's wrist.

2. The business form of claim 1 wherein said window has a length substantially longer than the length of the imaging portion to thereby allow a differing length of the window end to overlap the imaging end and yet still align with the imaging portion as it is adhered in place.

3. The business form of claim 2 wherein the adhesive comprises a layer of adhesive applied to the strap surrounding the imaging portion to thereby adhere the window end to the imaging end as the two ends are brought together about the wearer's wrist.

4. The business form of claim 3 wherein the strap is formed in a single ply of material.

5. The business form of claim 4 wherein the imaging portion comprises a coating of material applied to the single ply.

6. The business form of claim 4 wherein the imaging portion comprises a die cut portion of a layer adhered to said ply.

7. The business form of claim 1 further comprising a label portion die cut into said business form, said label portion forming at least one label.

8. The business form of claim 7 wherein the wristband is formed in a first portion thereof and the label portion is formed in a second portion thereof, and further comprising a plurality of said business forms arranged in a continuous strip.

9. The business form of claim 1 wherein said window comprises a clear laminate portion of said laminate strap.

10. A printer processable business form comprising a wrap around, self laminating wristband, said self laminating wristband comprising a wristband width laminate strap having an image receiving end and an opposing window end, and said strap being separable from said business form and further comprising a layer of adhesive applied solely to the image receiving end so that upon separation of said wristband from said business form and wrapping of the window end over the top of the image receiving end, the layer of adhesive adheres the two ends together to solely laminate an image applied to the image receiving end and secure the wristband to a wearer's wrist while leaving substantially no exposed adhesive along an inner surface of the wristband to contact the wearer's wrist.

11. The business form of claim 10 wherein the image receiving end has an image receiving portion and the window end comprises a transparent strap portion, and wherein said transparent strap portion has a length appreciably longer than the image receiving portion so that the window end may be wrapped around the image receiving end to different positions and yet still align the transparent strap portion with the image receiving portion.

12. The business form of claim 11 wherein said layer of adhesive substantially completely surrounds the image receiving portion so that as the window end is adhered it laminates the image receiving portion by substantially completely encapsulating it.

13. The business form of claim 12 wherein the image receiving portion comprises a second layer of material adhered to said strap.

14. The business form of claim 13 wherein said image receiving end has a smaller width than the window end so that said window end, if properly aligned as the two ends are brought together to be adhered, completely covers the image receiving portion.

15. The business form of claim 14 further comprising a plurality of said forms joined in a continuous strip.

16. The business form of claim 10 further comprising a plurality of self adhering labels.

17. The business form of claim 16 further comprising a plurality of said forms joined in a continuous strip.

18. The business form of claim 10 wherein said wristband is formed by at least one die cut in said business form.

19. The business form of claim 18 wherein said die cut is an interrupted die cut.

20. A printer processable business form comprising a wrap around, self laminating wristband, said self laminating wristband comprising a wristband width laminate strap having an image receiving end and a wrapping end, and said strap being separable from said business form and further comprising a layer of adhesive applied solely to the image receiving end when laminated so that upon separation of said wristband from said business form and wrapping of the wrapping end over the top of the image receiving end, the layer of adhesive adheres the two ends together to laminate any image on the image receiving end and secure the wristband to a wearer's wrist while leaving substantially no exposed adhesive along an inner surface of the wristband to contact the wearer's wrist.

21. The business form of claim 20 wherein said strap is substantially transparent at least at the wrapping end.

22. The business form of claim 21 wherein said strap is substantially transparent along substantially its entire length.

23. A substantially transparent laminate wristband strap, said strap having adhesive selectively applied to at least one end thereof and being sufficiently long to wrap around a wearer's wrist and extend past the opposite end to affix the wristband on a wearer's wrist and overlie any imprinted data appearing on said opposite end while leaving substantially no exposed adhesive along an inner surface of the wristband to contact the wearer's wrist.

24. The wristband strap of claim 23 further comprising a layer of imaging material applied to an end of said strap, said imaging material being adapted to receive and retain a printed image, and wherein said strap is substantially transparent so as to allow for viewing of the imprinted data lying underneath its opposite end.

25. The wristband strap of claim 24 wherein said adhesive comprises a patch of adhesive applied on at least one side of said imaging layer.

26. The wristband strap of claim 25 wherein said adhesive comprises a patch of adhesive applied to opposite sides of said imaging layer.

27. The wristband strap of claim 26 wherein said adhesive patches are substantially adjacent the imaging layer.

28. The wristband strap of claim 24 wherein said layer of imaging material comprises a label adhered to said strap.

29. The wristband strap of claim 24 wherein said layer of imaging material comprises a coating of thermally sensitive print material.

30. The wristband strap of claim 29 wherein said layer of imaging material is applied by spraying it onto the strap.

31. The wristband strap of claim 23 wherein a plurality of said straps are formed in a page with a line of weakness separating adjacent straps for easy separation therefrom and wherein at least some of said straps are substantially transparent so as to allow for viewing of the imprinted data when lying underneath its opposite end.

32. The wristband strap of claim 23 further comprising a self adhering label imprinted with information, said label being adhered to the strap opposite end, and wherein said strap is substantially transparent so as to allow for viewing of the imprinted data lying underneath its opposite end.

33. The wristband strap of claim 23 wherein said strap has a laminate layer and a face stock layer, said face stock layer being adapted to receive and retain printed information and positioned near the opposite end of said strap.

34. The wristband strap of claim 33 further comprising a carrier, said carrier having a face stock web and a laminate web, said face stock layer being defined by a die cut in said face stock web and said laminate layer being defined by a die cut in said laminate web, and wherein said face stock layer is adhered to said laminate layer.

* * * * *